US007148870B2

(12) United States Patent
Tada

(10) Patent No.: US 7,148,870 B2
(45) Date of Patent: Dec. 12, 2006

(54) FLAT-PANEL DISPLAY DEVICE

(75) Inventor: Norio Tada, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 494 days.

(21) Appl. No.: 10/352,889

(22) Filed: Jan. 29, 2003

(65) Prior Publication Data

US 2003/0142054 A1 Jul. 31, 2003

(30) Foreign Application Priority Data

Jan. 31, 2002 (JP) ..... 2002-024732

(51) Int. Cl.
*G09G 3/36* (2006.01)

(52) U.S. Cl. ..... 345/90; 345/98

(58) Field of Classification Search ..... 345/87–100, 345/204, 103; 349/33, 41
See application file for complete search history.

(56) References Cited

U.S. PATENT DOCUMENTS 5,712,652 A * 1/1998 Sato et al. ..... 345/90
5,945,972 A * 8/1999 Okumura et al. ..... 345/98
6,229,508 B1 * 5/2001 Kane ..... 345/82
6,771,247 B1 8/2004 Sato et al.
6,806,862 B1 * 10/2004 Zhang et al. ..... 345/103
6,853,370 B1 * 2/2005 Numao ..... 345/204
6,873,320 B1 * 3/2005 Nakamura ..... 345/204

* cited by examiner

*Primary Examiner*—Regina Liang
(74) *Attorney, Agent, or Firm*—Oblon, Spivak, McClelland, Maier & Neustadt, P.C.

(57) ABSTRACT

A flat-panel display device comprises display pixels PX, pixel switches which capture a video signal supplied externally, as voltages to be applied to the display pixels PX, static memory modules which hold the voltages applied from the pixel switches, and connection controllers which control electrical connections between the display pixels PX and the static memory modules. Particularly, each connection controller includes a thin film transistor having a dual-gate structure, which is connected between one display pixel PX and one memory module.

3 Claims, 4 Drawing Sheets

FLAT-PANEL DISPLAY DEVICE

CROSS-REFERENCE TO RELATED APPLICATIONS

This application is based upon and claims the benefit of priority from the prior Japanese Patent Application No. 2002-024732 filed Jan. 31, 2002, the entire contents of which are incorporated herein by reference.

BACKGROUND OF THE INVENTION

The present invention generally relates to a flat-panel display device which comprises memory modules added to display pixels and used in a still image display mode, and more particularly to a flat-panel display device in which the display pixels are electrically separated from the memory modules in an ordinary display mode other than the still image display mode.

For example, liquid crystal display devices are widely used as monitor displays for portable information terminals such as portable phones and PDAs (Portable Digital Assistants), since the devices have such characteristics as thinness, compactness and lightness. The portable information terminals generally operate using power from a rechargeable battery. Thus, the available period of the portable information terminal considerably depends on the rate of consuming the battery power. Under the circumstance, active research has been made to reduce the power consumption of the liquid crystal display device.

In recent years, the memory technology represented by SRAM (Static Random Access Memory) is used for reducing the power consumption of the liquid crystal display. With SRAM technology, memory modules are added to the display pixels forming a display screen. Each memory module is electrically connected to a corresponding display pixel by a connection controller. When an external driving circuit supplies a video signal in this state, the video signal is captured by a pixel switch and supplied to the display pixel. The memory module holds the video signal supplied to the display pixel and drives the display pixel according to the video signal. Thus, in the case where frequent update of the display signal is not required, a still image can be displayed by causing the output operation of the external driving circuit to be intermittent.

In the field of liquid crystal display devices, frame-inversion driving is generally known. In this driving, the polarities of video signal voltages to be applied to the display pixels are inverted, for example, every vertical scanning (frame) period in order to prevent uneven distribution of liquid crystal materials. In addition to frame-inversion driving, H-line inversion driving and V-line inversion driving are known and used for suppressing generation of flicker. In H-line inversion driving, the polarities of the voltages are inverted in units of display pixels of one or more rows. In V-line inversion driving, the polarities of the voltages are inverted in units of display pixels of one or more columns. In liquid crystal display devices containing memory modules, the H-line inversion driving is used in the ordinary display mode and the frame-inversion driving is used in the still image display mode, for example, to further reduce the power consumption. The connection controller is used not only for controlling the electrical connection between the display pixel and the memory module, but also for controlling the polarity inversion described above.

However, with respect to the liquid crystal display devices containing memory modules, it is reported that a significant number of defective pixels appear on the display screen in the ordinary display mode.

BRIEF SUMMARY OF THE INVENTION

An object of the present invention is to provide a flat-panel display device which can reduce the number of defective pixels in the ordinary image display so as to secure high quality and reliability.

According to the present invention, there is provided a flat-panel display device which comprises a plurality of display pixels, a plurality of pixel switches which capture a video signal supplied externally, as voltages to be applied to the display pixels, a plurality of memory modules which hold the voltages applied from the pixel switches, and a plurality of connection controllers which control electrical connections between the display pixels and the memory modules, each connection controller including a series-switch circuit connected between one display pixel and one memory module.

The inventor has performed experiments on the fact that a significant number of defective pixels appear in an ordinary display mode and finally found out that the defective pixels are caused by the connection controllers. More specifically, a thin film transistor having a single gate structure is generally used as the connection controller, and the source-drain voltage of the thin film transistor increases when the display pixel is electrically separated from the memory module in the ordinary display mode. It is confirmed that a leakage current flows upon increase in the source-drain voltage and makes it difficult to properly drive the display pixel according to the video signal.

With the flat-panel display device described above, each connection controller includes a series-switch circuit connected between one display pixel and one memory module. Such a series-switch circuit is formed, for example, of a thin film transistor having a dual-gate structure, and suppresses the leakage current. Therefore, the number of defective pixels can be reduced to secure the high quality and reliability of the flat-panel display device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

A flat-panel display device according to one embodiment of the present invention is described below with reference to the accompanying drawings. The flat-panel display device is a liquid crystal display device used as a monitor display for a portable information terminal which has an ordinary display mode for displaying a moving or still image and a still image display mode for displaying a still image to reduce power consumption, for example.

Figure 1:
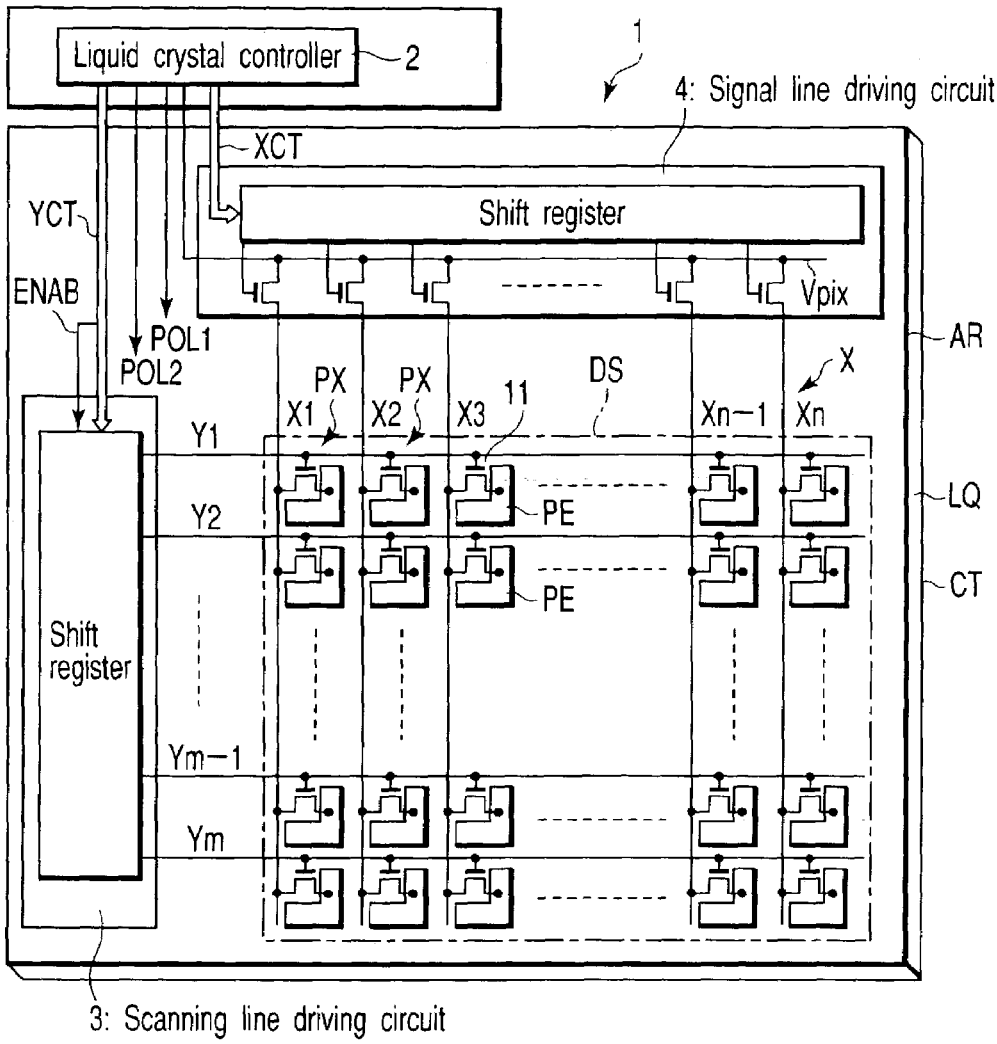
FIG. 1 is a diagram showing the schematic circuit configuration of a flat-panel display device according to one embodiment of the present invention.
Figure 2:
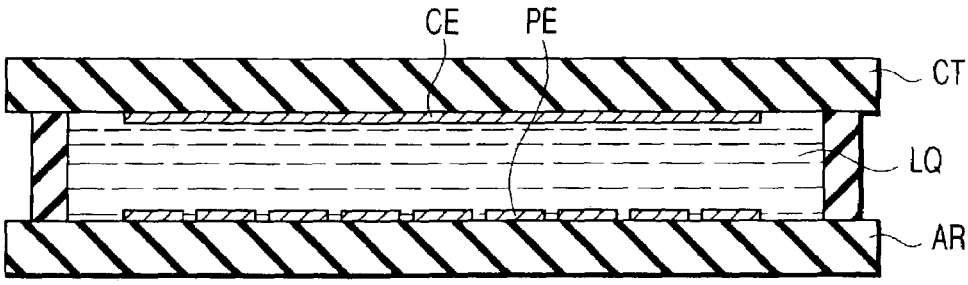
FIG. 2 is a diagram showing the schematic cross-sectional structure of the flat-panel display device shown in FIG. 1.
Figure 3:
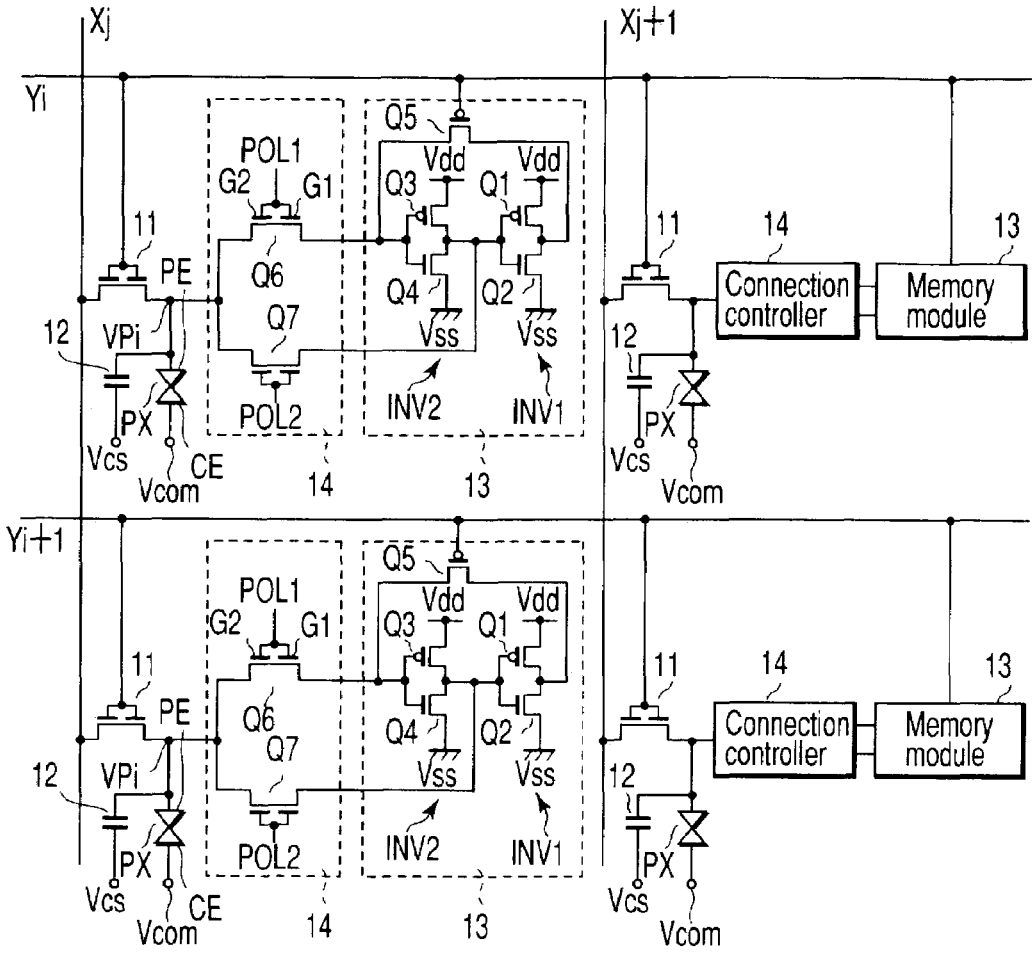
FIG. 3 is a diagram showing the equivalent circuit corresponding to some of the display pixels shown in FIG. 1.

FIG. 1 shows the schematic circuit configuration of the flat-panel display device. FIG. 2 shows the schematic cross-sectional structure of the flat-panel display device. FIG. 3 shows the equivalent circuit corresponding to some of the display pixels shown in FIG. 1.

The flat-panel display device comprises a liquid crystal display panel 1 and a liquid crystal controller 2 which controls the liquid crystal display panel 1. The liquid crystal panel 1 has a structure that a liquid crystal layer LQ is held between an array substrate AR and a counter substrate CT, for example. The liquid crystal controller 2 is disposed on a driving circuit board provided independently of the liquid crystal display panel 1.

The array substrate AR comprises a plurality of pixel electrodes PE arrayed in a matrix form within a display area DS on a glass substrate, a plurality of scanning lines Y (Y1 to Ym) formed along rows of the pixel electrodes PE, a plurality of signal lines X (X1 to Xn) formed along columns of the pixel electrodes PE, a plurality of pixel switches 11 which are disposed near intersections between the signal lines X1 to Xn and the scanning lines Y1 to Ym, and each of which captures a video signal from a corresponding signal line X in response to a scanning signal from a corresponding scanning line Y as a voltage to be applied to a corresponding pixel electrode PE, a scanning line driving circuit 2 which drives the scanning lines Y1 to Ym, and a signal line driving circuit 4 which drives the signal lines X1 to Xn. Each pixel switch 11 is formed, for example, of an N-channel polysilicon thin film transistor. The scanning line driving circuit 3 and the signal line driving circuit 4 are integrated on the array substrate AR using thin film transistors formed along with the thin film transistors serving as the pixel switches 11. The counter substrate CT comprises a single counter electrode CE disposed to face the pixel electrodes PE and set to a common potential Vcom, and a color filter (not shown).

The liquid crystal controller 2 receives a video signal and a sync signal supplied externally to produce a pixel video signal Vpix, a vertical scanning control signal YCT and a horizontal scanning control signal XCT in ordinary display mode. The vertical scanning control signal YCT includes a vertical start pulse, a vertical clock signal, and an output enable signal ENAB, for example, and is supplied to the scanning line driving circuit 3. The horizontal scanning control signal XCT includes a horizontal start pulse, a horizontal clock signal, and a polarity inversion signal, for example, and is supplied to the signal line driving circuit 4 together with the video signal Vpix.

The scanning line driving circuit 3 includes a shift register, and is controlled by the vertical scanning control signal YCT such that a scanning signal for turning on the pixel switches 11 is sequentially supplied to the scanning lines Y1 to Ym every vertical scanning (frame) period. The shift register selects one of the scanning lines Y1 to Ym by shifting the vertical start pulse, which is supplied every vertical scanning period, in synchronism with the vertical clock signal, and outputs the scanning signal to the selected scanning line with reference to the output enable signal ENAB. The output enable signal ENAB is maintained at a high level to enable an output of the scanning signal in an effective scanning period included in the vertical scanning (frame) period, and at a low level to disable the output of the scanning signal in a vertical blanking period obtained by excluding the effective scanning period from the vertical scanning period.

The signal line driving circuit 4 includes a shift register and a sampling output circuit, and is controlled by the horizontal scanning control signal XCT to perform a serial-to-parallel conversion of sequentially sampling the video signal Vpix input every horizontal scanning period (1H), in which one scanning line is driven by the scanning signal, as analog voltages supplied to the signal lines X1 to Xn.

The counter electrode CE is set at the common potential Vcom as shown in FIG. 3. The common potential Vcom is level-inverted from one of 0 V and 5 V to the other every horizontal scanning period in the ordinary display mode, and level-inverted from one of 0 V and 5 V to the other every frame period (1F) in the still image display mode. As for the ordinary display mode, the common potential Vcom may be level-inverted every period corresponding to two horizontal scanning periods (2H) or every frame period, instead of every horizontal scanning period (1H) described above in this embodiment.

The polarity inversion signal is supplied to the signal line driving circuit 4 in synchronism with level-inversion of the common potential Vcom. In the ordinary display mode, the signal line driving circuit 4 outputs the video signal Vpix which is level-inverted within the amplitude range of 0 V to 5 V in response to the polarity inversion signal so as to have an opposite polarity with respect to the common potential Vcom. In the still image display mode, the signal line driving circuit 4 outputs the video signal Vpix in which the number of gradations is restricted for a still image, and is suspended thereafter.

The liquid crystal layer LQ of the liquid crystal panel 1 is of a normally white type in which black is displayed when the video signal Vpix of 5 V is applied to the pixel electrode PE with respect to the common potential Vcom of 0 V set to the counter electrode CE, for example. As described above, the H-line (or H-common) inversion driving is used in the ordinary display mode. Thus, the potential relationship between the video signal Vpix and the common potential Vcom is inverted every horizontal scanning period (1H). Further, the frame inversion driving is used in the still image display mode. Thus, the potential relationship between the video signal Vpix and the common potential Vcom is inverted every frame period.

The display screen is formed by the display pixels PX. Each display pixel PX includes one of the pixel electrodes PX, the counter electrode CE, and the liquid crystal material held between-the pixel electrode PE and the counter electrode CT. Further static memory modules 13 and connection controllers 14 are provided for the display pixels PX, respectively. As shown in FIG. 3, the pixel electrode PE is connected to the pixel switch 11 which selectively captures the video signal Vpix on the signal line X, and is capacitively coupled with a storage capacitance line set to a potential Vcs which is equal to the common potential Vcom on the counter electrode CE, for example. The pixel electrode PE and the counter electrode CE form a liquid crystal capacitance using the liquid crystal material interposed therebetween. The pixel electrode PE and the storage capacitance line form a storage capacitance parallel to the liquid crystal capacitance 12, without using the liquid crystal material.

When the pixel switch 11 is driven by the scanning signal from the scanning line Y, the video signal Vpix on the signal line X is supplied to the display pixel PX. The storage capacitance 12 is significantly greater than the liquid crystal capacitance, and is charged or discharged according to a voltage of the video signal Vpix applied to the pixel electrode PE. As a result of charging or discharging, the voltage of the video signal Vpix is held in the storage capacitance 12, and prevents fluctuation in the voltage held in the liquid crystal capacitance when the pixel switch 11 is turned off. Accordingly, the difference in the potential between the pixel electrode PE and the counter electrode CE can be maintained.

Each static memory module 13 includes P-channel poly-silicon thin film transistors Q1, Q3, and Q5, and N-channel poly-silicon thin film transistors Q2 and Q4 to hold the video signal Vpix supplied from the pixel switch 11. Each connection controller 14 includes N-channel poly-silicon thin film transistors Q6 and Q7 to control electrical connection between the display pixel PX and the static memory module 13 and also control the output polarity of the video signal held in the static memory module 13 as a polarity control circuit. The thin film transistors Q1 and Q2 serve as a first inverter circuit INV1 which operates under the power voltage between the power terminal Vdd (=5V) and the power terminal Vss (=0V). The thin film transistors Q3 and Q4 serve as a second inverter circuit INV2 which operates under the power voltage between the power terminals Vdd and Vss. An output terminal of the inverter circuit INV1 is connected to an input terminal of the inverter circuit INV2 via the thin film transistor Q5, which is controlled from the scanning line Y. An output terminal of the inverter circuit INV2 is connected to an input terminal of the inverter circuit INV1. The scanning signal from the scanning line Y rises to turn on the pixel switch 11 in one frame period. The thin film transistor Q5 does not turn on while the pixel switch 11 is conductive, and turns on before the pixel switch 11 turns on in the next frame period. That is, the thin film transistor Q5 is kept nonconductive for at least a period during which the pixel switch 11 captures the video signal Vpix.

Figure 4:
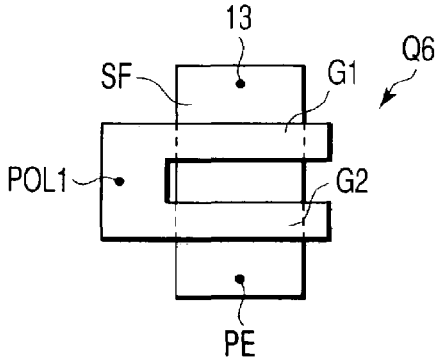
FIG. 4 is a diagram showing the plan structure of a thin film transistor having a dual-gate structure and shown in FIG. 3.

As shown in FIG. 4, the thin film transistor Q6 has a dual-gate structure that two gate electrodes G1 and G2 are formed over and insulated from a polysilicon semiconductor thin film SF. The thin film transistor Q7 has the same dual-gate structure as that of the thin film transistor Q6. In addition, each of the thin film transistors Q6 and Q7 also has an LDD (Lightly Doped Drain) structure wherein the ratio of width to length (W/L) is 3 μm/3 μm and the length of the LDD is 1 μm, for example.

The thin film transistors Q6 and Q7 are respectively controlled by polarity control signal POL1 and POL2 which are alternately set at a high level for one frame period in the still image display mode, for example. The thin film transistor Q6 is connected between the pixel electrode PE and the input terminal of the inverter circuit INV2, which is connected to the output terminal of the inverter circuit INV1 via the thin film transistor Q5. The thin film transistor Q7 is connected between the pixel electrode PE and the input terminal of the inverter circuit INV1, which is connected to the output terminal of the inverter circuit INV2.

Figure 5:
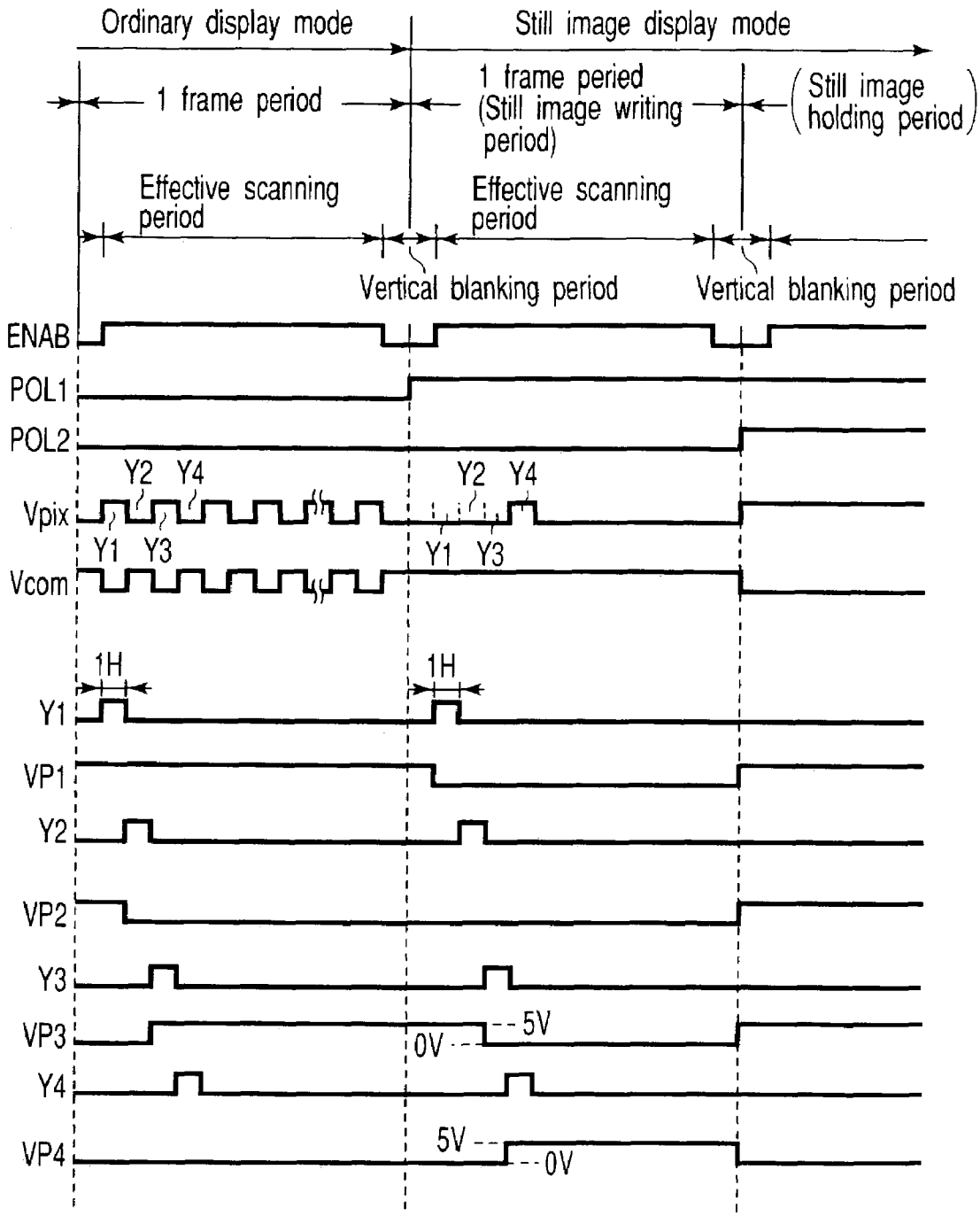
FIG. 5 is a timing chart showing operation waveforms of the flat-panel display device shown in FIG. 1.

Operation of this flat-panel display will be described below. As shown in FIG. 5, the liquid crystal controller 2 maintains the polarity control signals POL1 and POL2 at a low level, while the scanning line driving circuit 3 sequentially supplies a scanning signal to the scanning lines Y (Y1 to Ym) every frame period. Each scanning line Y is maintained at a high level for one horizontal scanning period (1H) by the scanning signal. The signal line driving circuit 4 supplies the signal lines X (X1 to Xn) with a video signal for one row, which is level-inverted every horizontal scanning period. The pixel switch 11 of each display pixel PX turns on by the scanning signal from a corresponding scanning line Y, and captures the video signal Vpix on a corresponding signal line X as a voltage to be applied to a corresponding pixel electrode PE. After the horizontal scanning period, the pixel switch 11 turns off and the pixel electrode PE is brought into an electrically floating state. The voltage of the video signal Vpix is held by the liquid crystal capacitance and the storage capacitance 12 until the pixel switch 11 turns on again. Meanwhile, the transmittance of the display pixel PX is set according to the difference in the potential between the pixel electrode PE and the counter electrode CE.

When the display device is switched to the still image display mode, the polarity control signals POL1 and POL2 are respectively maintained at a high level and at a low level in a still image writing period, which is the initial one of succeeding frame periods, so that the video signal Vpix for each row of a still image is supplied to the signal lines X in a corresponding horizontal scanning period of the frame period. The other succeeding frame periods serve as a still image holding period. In the still image holding period, the polarity control signals POL1 and POL2 are alternately set at a high level for one frame period so as to invert the output polarity of the static memory module 13.

As described above, the polarity control signal POL1 is maintained at a high level in the first frame period serving as the still image writing period for the still image display mode. As a result, a video signal representing a still image in two gradations is applied to the pixel electrode PE via the pixel switch 11 and to the static memory module 13 via thin film transistor Q6. For example, when the polarity control signals POL1 and POL2 have become respectively at a low level and at a high level in the still image holding period, the video signal Vpix is level-inverted by the inverter circuit INV2 and supplied as an output video signal to the pixel electrode PE via the thin film transistor Q7. The operation in the still image writing period for the still image display mode will be described more in detail. Assume that the potentials VP1, VP2, VP3, and VP4 of the display pixels PX in the first to fourth rows have been set respectively at 5 V, 0 V, 5 V, and 0 V to obtain the same gradation by line-inversion driving, and the video signal Vpix for a still image is set at 5 V only in the horizontal scanning period during which the fourth scanning line Y4 is driven and at 0 V in the other horizontal scanning periods. In this case, the pixel potential VP1 changes from 5 V to 0 V in the still image writing period, and the pixel potential VP2 is maintained at 0 V in the still image writing period. On the other hand, the pixel potential VP3 changes from 5 V to 0 V, and the pixel potential VP4 changes from 0 V to 5 V.

With the flat-panel display device according to the present embodiment, each connection controller 14 includes the thin film transistors Q6 and Q7 connected between a corresponding display pixel PX and a corresponding static memory module 13. Each of the thin film transistors Q6 and Q7 has a dual-gate structure and LDD structure so as to suppress a leakage current from flowing between the display pixel PX and the static memory module 13 when these transistors Q6 and Q7 become nonconductive in the ordinary display mode. Therefore, the number of defective pixels can be reduced to secure the high quality and reliability of the flat-panel display device. Since the dual-gate structure (or multi-gate structure) is associated with the LDD structure, the leakage current can be effectively suppressed by increasing the LDD length as compared with the case where a thin film transistor having a single gate structure is used and the channel length thereof is increased. In addition, the dual-gate structure allows a substantial increase in the LDD lengths of the thin film transistors Q6 and Q7 without adversely affecting the LDD lengths of the other thin film transistors. Moreover, since only the thin film transistors Q6 and Q7 can be selected for the substantial increase, no influence appears in the operation characteristics of the other thin film transistors.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Figure 6:
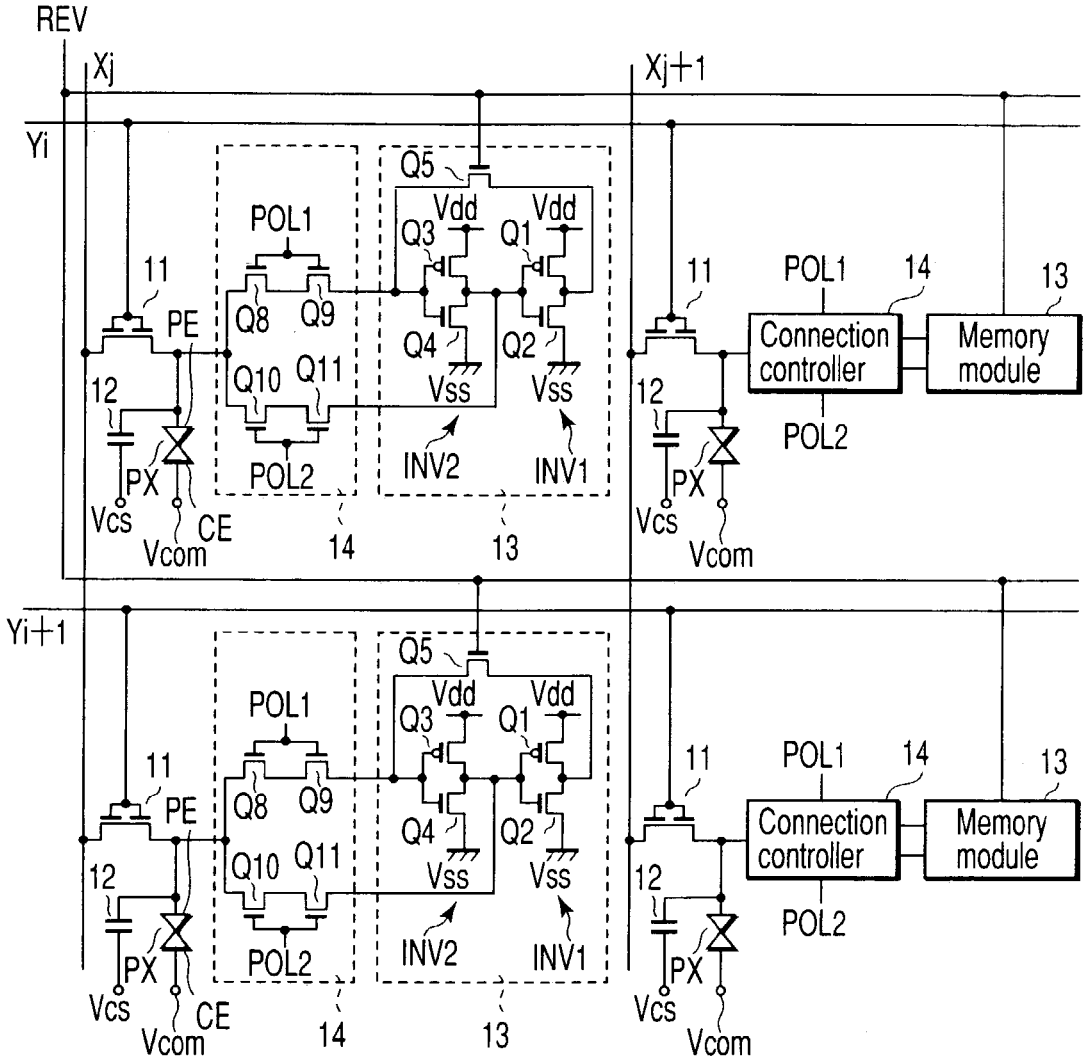
FIG. 6 is a diagram showing a modification of the circuit shown in FIG. 3.

FIG. 6 shows a modification of the circuit shown in FIG. 3. In the above-mentioned embodiment, each of the N-channel thin film transistors Q6 and Q7 has the LDD structure and the dual-gate structure. However, these thin film transistors Q6 and Q7 may be modified as shown in FIG. 6. In this modification, the thin film transistor Q6 is replaced by a pair of N-channel thin film transistors Q8 and Q9 connected in series, and the thin film transistor Q7 is replaced by a pair of N-channel thin film transistors Q10 and Q11 connected in series. Even with the above-mentioned configuration, a leakage current can be suppressed from flowing between the display pixel PX and the static memory module 13 in the ordinary display mode. Further, in the case where the thin film transistor Q5 of the static memory module 13 is of the N-channel type, the thin film transistor Q5 may be independently controlled by a control signal REV produced from a signal generating part of the liquid crystal controller 2, for example.

Moreover, in the above-mentioned embodiment, the flat-panel display device is described as a liquid crystal display device. However, the present invention is also applicable to organic EL (Electro-Luminescent) display devices or the like.

What is claimed is:

1. A flat-panel display device comprising: a plurality of display pixels;

a plurality of pixel switches which capture a video signal supplied externally, as voltages to be applied to said display pixels;

a plurality of memory modules which are respectively assigned to said display pixels; and hold the voltages applied from said pixel switches to said display pixels; and a plurality of connection controllers which control electrical connections between the display pixels and the memory modules, each connection controller including a series-switch circuit connected between one display pixel and one memory module and includes a thin film transistor having a dual-gate structure;

wherein said series-switch circuits serve to electrically connect the memory modules to the display pixels in a still image display mode and electrically disconnect the memory modules from the display pixels in an ordinary display mode other than said still image display mode.

2. A flat-panel display device according to claim 1, wherein said memory module includes first and second inverter circuits serving as a static memory.

3. A flat-panel display device according to claim 2, wherein said series-switch circuit includes first and second series-switching elements which alternately turn on to apply one of voltages output from said first and second inverter circuits every predetermined period as a polarity control circuit.

* * * * *